United States Patent [19]

Reimer

[11] Patent Number: 4,591,219

[45] **Date of Patent: * May 27, 1986**

[54] LOW INSERTION FORCE CONNECTION ARRANGEMENT

[75] Inventor: William A. Reimer, Wheaton, Ill.

[73] Assignee: GTE Communication Systems Corporation, Northlake, Ill.

[ * ] Notice: The portion of the term of this patent subsequent to Mar. 12, 2002 has been disclaimed.

[21] Appl. No.: 679,795

[22] Filed: Dec. 10, 1984

Related U.S. Application Data

[63] Continuation-in-part of Ser. No. 527,638, Aug. 29, 1983, Pat. No. 4,505,527.

[51] Int. Cl.[4] ..... H01R 9/09

[52] U.S. Cl. ..... 339/17 LM; 339/75 MP; 339/176 MP; 339/205

[58] Field of Search ..... 339/17 L, 17 LM, 74 R, 339/75 MP, 176 MP, 204, 205

[56] References Cited

U.S. PATENT DOCUMENTS

| | | | |
|---|---|---|---|
| 3,611,259 | 10/1971 | Palecek | 339/74 R |
| 4,076,362 | 2/1978 | Ichimura | 339/75 MP |
| 4,080,027 | 3/1978 | Benasutti | 339/75 MP |
| 4,176,900 | 12/1979 | Hines et al. | 339/176 MP |
| 4,189,200 | 2/1980 | Yeager et al. | 339/75 MP |
| 4,230,388 | 10/1980 | Thierry et al. | 339/74 R |
| 4,266,839 | 5/1981 | Aikens | 339/75 MP |
| 4,274,699 | 6/1981 | Keim | 339/176 MP |
| 4,275,944 | 6/1981 | Sochor | 339/74 R |
| 4,327,955 | 5/1982 | Minter | 339/75 MP |
| 4,400,049 | 8/1983 | Schuck | 339/176 MP |
| 4,504,101 | 3/1985 | Reimer | 339/176 MP |
| 4,505,527 | 3/1985 | Reimer | 339/176 MP |
| 4,505,528 | 3/1985 | Reimer | 339/176 MP |

*Primary Examiner*—John McQuade

*Attorney, Agent, or Firm*—Robert J. Black; Gregory G. Hendricks

[57] ABSTRACT

A low insertion force connection arrangement for establishing a connection between at least two printed wiring boards each of the type including at least one printed wiring board terminal. The connection arrangement includes at least one connection spring including an actuator engaging area located centrally on a side of the spring facing the printed wiring boards and between two pivot points. The pivot points are located on a side of the connection spring facing away from the printed wiring boards and between two contacts. The contacts are located at opposite ends of the connection spring facing and in alignment with corresponding ones of the printed wiring board terminals. A connector body is provided including a plurality of grooves each adapted to receive and retain one of the printed wiring boards in alignment with the other, and a cavity, including molded-in fulcrums opposite the spring's pivot points, in which the connection spring is retained by means of spring fingers acting against recesses formed in the cavity walls. An actuator is linearly positioned to engage the actuator engaging area to pivot the connection spring about its pivot points and against the fulcrums to engage the spring contacts with the printed wiring board terminals.

5 Claims, 5 Drawing Figures

LOW INSERTION FORCE CONNECTION ARRANGEMENT

CROSS-REFERENCES TO RELATED APPLICATIONS

This is a continuation-in-part of application Ser. No. 527,638, filed Aug. 29, 1983 and issued Mar. 19, 1985 as U.S. Pat. No. 4,505,527.

Related, commonly assigned, co-pending continuation-in-part applications include "Low Insertion Force Connection Arrangement," Ser. No. 679,794, "Low Insertion Force Connection Arrangement," Ser. No. 680,218, and "Low Insertion Force Connection Arrangement," Ser. No. 679,793, all filed concurrently herewith and invented by the same inventor.

Related, commonly assigned, co-pending applications include "Printed Wiring Board File," Ser. No. 527,635, issued July 30, 1985 as U.S. Pat. No. 4,532,576; "Double File Printed Wiring Board Module," Ser. No. 527,634, issued Aug. 27, 1985 as U.S. Pat. No. 4,538,209; "Printed Wiring Board Interconnect Arrangement," Ser. No. 527,636, issued Feb. 12, 1985 as U.S. Pat. No. 4,498,717; "Low Insertion Force Connection Arrangement," Ser. No. 527,637, issued Mar. 12, 1985 as U.S. Pat. No. 4,504,101; and "Low Insertion Force Connection Arrangement," Ser. No. 527,639, issued Mar. 19, 1985 as U.S. Pat. No. 4,505,528; all filed Aug. 29, 1983 and invented by the same inventor.

BACKGROUND OF THE INVENTION

The present invention relates to arrangements for establishing connection to printed wiring boards and more particularly to a low insertion force arrangement for interconnecting two or more printed wiring boards.

Printed wiring board interconnect arrangements are very well known to those skilled in the art. One type, described in U.S. Pat. No. 3,771,100 issued on Nov. 6, 1973 to Norman Leonard Reed. This type includes a contact which is integrally formed by folding a sheet metal blank. It comprises a pair of elongated spring arms supported longitudinally and spaced apart at one of their ends by an elongated body portion. The arms extend in opposite directions away from their supporting ends and each arm extends towards the supporting end of the other arm so that they overlap or cross. Contact portions are located at the free ends of each arm adjacent to the supported end of the other arm and they face away from the spring body. Each contact is mounted in a slot within a carrier block of insulating material by latch arms formed on the body portion which project away from the spring arms and engage a shoulder formed in the carrier block.

Another arrangement for interconnecting printed wiring boards is described in U.S. Pat. No. 3,871,736 which was issued on Mar. 18, 1975 to Carter, et al. This patent teaches an electrical connector mounted in a housing to electrically and mechanically interconnect a pair of parallel adjacent printed wiring boards and to connect the printed wiring boards to an adjacent terminal. Pairs of resilient, parallel, spaced apart legs extend from a connector body and are adapted to resiliently grip the printed wiring boards therebetween.

U.S. Pat. No. 4,255,003, which was issued on Mar. 10, 1981 to William E. Berg, teaches an electrical connector for interconnecting conductive paths of two circuit elements by means of the following: a contact member including a concave portion interposed between two convex portions; a resilient member conforming to the contact member in part; and a connector body, so formed that when the body is forced against the circuit elements, the resilient member forces the contact member into engagement with the circuit element conductive paths.

Devices permitting connection to printed wiring boards are also well known in the art. In this regard, zero insertion force, edge board connectors have been disclosed in U.S. Pat. No. 4,189,200 issued Feb. 19, 1980 to Yeager, et al., and U.S. Pat. No. 4,159,861 issued July 3, 1979 to Anhalt. These connectors include cantilevered contacts biased toward the printed wiring board and positioned out of engagement with the board for insertion purposes. Connectors including cantilevered contacts biased against the printed wiring board and temporarily retracted from contact with the board directly by means of an actuator are disclosed in U.S. Pat. No. 3,793,609 issued Feb. 19, 1974 to McIver, and U.S. Pat. No. 3,848,221 issued Nov. 12, 1974 to Lee. Finally, a low insertion force connector including cantilevered contacts biased out of engagement with the printed wiring board and positioned into engagement with the printed wiring board through the use of actuators is taught in U.S. Pat. No. 4,176,900 issued Dec. 4, 1979 to Heinz, et al.

The art cited is seen to teach various arrangements of cantilevered or resiliently biased contact springs for connecting to or interconnecting printed wiring boards.

SUMMARY OF THE INVENTION

The present invention provides a low insertion force arrangement for establishing a connection between at least two printed wiring boards. Each board is of the type that includes at least one printed wiring board terminal. The connection arrangement includes the following: at least one connection spring having first and second contacts, each engageably positioned relative to a corresponding one of the terminals; first and second pivot points; and an actuator engaging area. First and second fulcrums are included in the arrangement and are positioned to engage the spring at the first and second pivot points, respectively. An actuator is also included and it is located proximate to the spring at the actuator engaging area. The actuator is linearly positioned in a first position relative to the spring to pivot the spring and engage the contacts with their respective terminals. It is then linearly advanced to a second position relative to the spring to pivot the spring and disengage the contacts from their respective terminals.

BRIEF DESCRIPTION OF THE DRAWING

Various features and advantages of a zero insertion force connection arrangement in accordance with the present invention will be apparent from the following description taken in conjunction with the accompanying drawing in which.

DETAILED DESCRIPTION OF THE INVENTION

Figure 1:
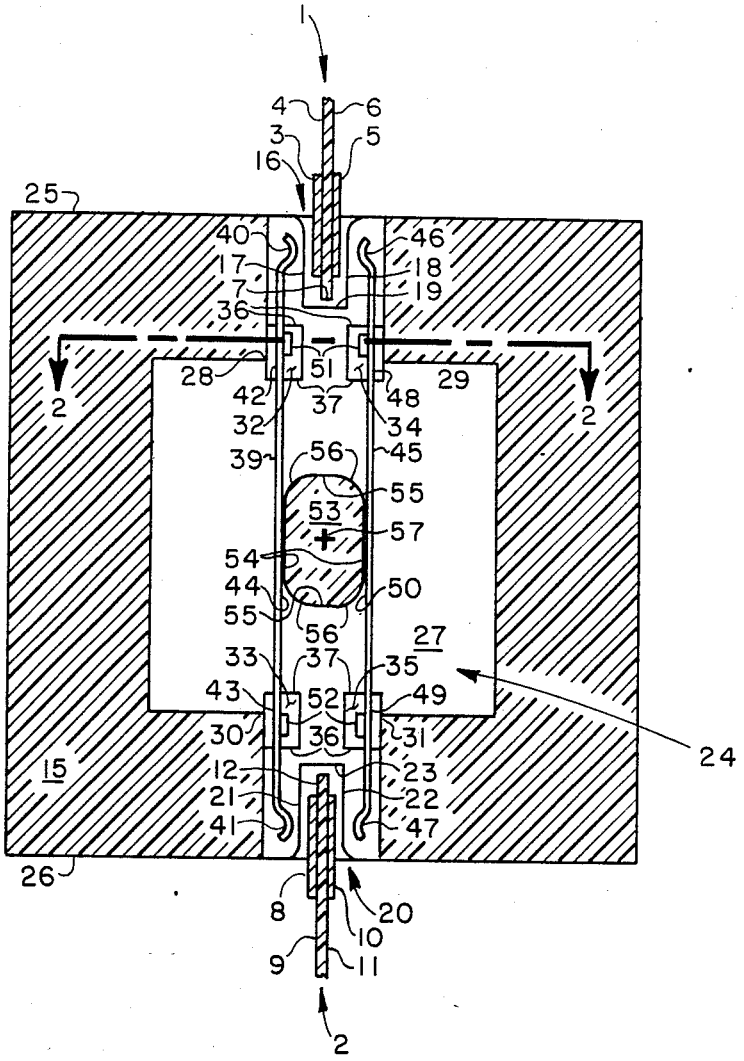
FIG. 1 is a cross sectional view of a zero insertion force connection arrangement for two printed wiring boards in accordance with the present invention.

Referring now to FIG. 1 there is shown an arrangement for connecting a first printed wiring board 1 to a second printed wiring board 2. The first printed wiring board 1 includes a first plurality of terminals 3 located on a first side 4 and a second plurality of terminals 5 located on a second side 6. The first terminals 3 and the second terminal 5 are located near an edge 7 of the first printed wiring board 1. Similarly, the second printed wiring board 2 includes a first plurality of terminals 8 located on a first surface 9 and a second plurality of terminals 10 located on a second surface 11. The first plurality of terminals 8 and the second plurality of terminals 10 are located near an edge 12 of the second printed wiring board.

A connector body 15 is provided with a first groove 16 including a first wall 17, a second wall 18, and a floor 19. The connector body 15 also includes a second groove 20 including a first wall 21, a second wall 22, and a floor 23.

Figure 2:
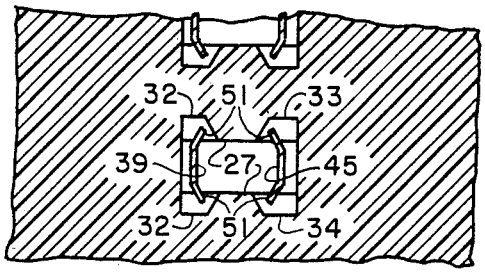
FIG. 2 is a sectional view taken along line 2—2 in FIG. 1.

A plurality of spring receiving cavities 24 are formed in the connector body 15 in alignment with corresponding groups of one of each of the terminals 3, 5, 8, and 10. The cavities 24 extend between a first side 25 and a second side 26 of the connector body 15 and include a pair of parallel opposite walls 27 (such walls are shown in FIG. 2). A first fulcrum 28 and a second fulcrum 29 are each formed in each of the spring receiving cavities 24, between the opposite walls 27, near the first side 25 of the connector body 15, and near the first side 4 and the second side 6 of the first printed wiring board 1, respectively. Similarly, a third fulcrum 30 and a fourth fulcrum 31 are formed in each of the spring receiving cavities 24, between the opposite walls 27, near a second side 26 of the connector body 15 and near the first side 9 and the second side 11 of the second printed wiring board 2, respectively.

Referring to FIG. 2, a first pair of recesses 32 and a second pair of recesses 33 (shown in FIG. 1) are formed in the walls 27 of each of the spring receiving cavities 24 near the first sides 4 and 9 of the printed wiring boards 1 and 2, respectively. Similarly, a third pair 34 and a fourth pair 35 (shown in FIG. 1) of recesses are formed in the walls 27 of each of the spring receiving cavities 24 near the second sides 6 and 11 of the printed wiring boards 1 and 2, respectively. Referring again to FIG. 1, each of the recesses 32 through 35 is elongated and includes an outer edge 36 and an inner edge 37. Each of the spring receiving cavities 24 intersects the first printed wiring board receiving groove 16 and the second printed wiring board receiving groove 20.

Each of the spring receiving cavities 24 includes an elongated first spring 39 positioned therein. Each of the first springs 39 includes a first contact 40, a second contact 41 positioned at opposite ends thereof. The first contact 40 of each of the first springs 39 is positioned proximate to a corresponding one of the first contacts 3 of the first printed wiring board 1 and the second contact 41 of each of the first springs 39 is positioned proximate to a corresponding one of the first contacts 8 of the second printed wiring board 2. Each of the first springs 39 includes a first pivot point 42 and a second pivot point 43 positioned on a side of the spring facing away from the printed wiring boards 1 and 2 and located between the first contact 40 and the second contact 41. An actuator engaging area 44 is positioned on a side of each of the first springs 39 facing the printed wiring boards 1 and 2 and located between the pivot points 42 and 43. Similarly, each of the spring receiving cavities 24 includes a second spring 45 including a first contact 46 positioned proximate to a corresponding one of the second terminals 5 of first printed wiring board 1 and a second contact 47 positioned proximate to a corresponding one of the second terminals 10 of the printed wiring board 2. Each of the second springs 45 includes a first pivot point 48 and a second pivot point 49 positioned on a side of the spring facing away from the printed wiring boards 1 and 2 and located between the first contact 46 and the second contact 47. An actuator engaging area 50 is positioned on a surface of the second spring 45 facing towards the printed wiring boards 1 and 2 and located between the pivot points 48 and 49. The pivot points 42, 43, 48, and 49 are positioned to engage the fulcrums 28, 30, 29, and 31, respectively, when the springs 39 and 45 are operated as described below.

Referring to FIG. 2, each of the first springs 39 and the second springs 45 includes a first pair of retaining fingers 51 and a second pair of retaining fingers 52 (see FIG. 1) to retain the springs within their respective cavities 24 while permitting spring movement about the pivot points 42, 43, 48, and 49. Referring again to FIG. 1, the first pair of retaining fingers 51 are attached to each of the first springs 39 near the first pivot point 42 and to each of the second springs 45 near the first pivot point 48. Similarly, the second pair of retaining fingers 52 are attached to each of the first springs 39 near each of the second pivot points 43 and to each of the second springs 45 near each of the second pivot points 49.

An actuator 53 is included between each corresponding pair of the first actuator engaging areas 44 and the second actuator engaging area 50 and includes a pair of low points 54 and a pair of high points 55 connected by a plurality of cam surfaces 56. Each of the actuators 53 is arranged to pivot about a pivot point 57.

Referring to FIG. 1, the connector of the present invention is operated by rotating the actuator 53 to place the low points 54 in contact with the actuator engaging areas 44 and 50. In this position, the first spring 39 and the second spring 45 are in their unactuated positions. The first contacts 40 and 46 are out of engagement with the first contacts 3 and the second contacts 5 of the first printed wiring board 1. Similarly, the second contacts 41 and 47 are out of contact with the first terminals 8 and the second terminals 10 of the printed wiring board 2. The first spring 39 is held in place while unactuated by the first retaining fingers 51 and the second retaining fingers 52 of the spring acting against the outer edges 36 of the first recesses 32 and the second recesses 33, respectively. Similarly, the second spring 45 is held in place while unactuated by the first retaining fingers 51 and the second retaining fingers 52 of the spring acting against the outer edges 36 of the third recess 34 and the fourth recess 35, respectively.

The printed wiring boards 1 and 2 may now be inserted into the first groove 16 and second groove 20 with low insertion force to the point where edges 7 and 12 abut groove floors 19 and 23, respectively. Once inserted, the first terminal 3 of the first printed wiring board 1 may be connected to the first terminal 8 of the second printed wiring board 2 and the second terminal 5 of the first printed wiring board 1 may be connected to the second terminal 10 of the second printed wiring board 2 by rotating the actuator 53. In this regard, the actuator 53 is rotated 90 degrees in either direction to place the high points 55 in contact with the actuator engaging areas 44 and 50, thus deflecting the first and second springs 39 and 45.

As the springs 39 and 45 are deflected, the actuator engaging areas 44 and 50 move away from each other causing the springs to pivot about their first pivot points 42 and 48 acting against the fulcrums 28 and 29, respectively, and their second pivot points 43 and 49 acting against the fulcrums 30 and 41, respectively, thus moving the first contacts 40 and 46 into engagement with the terminals 3 and 5 of the first printed wiring board 1 and the second contacts 41 and 47 into engagement with the terminals 8 and 10 of the second printed wiring board 2. Following engagement of the contacts 40, 46, 41, and 47 with the terminals 3, 5, 8, and 10, further movement of the actuator engaging areas 44 and 50 away from each other causes spring segments between the actuator engaging areas and their contacts to deflect and wipe the contacts against their respective terminals. Wiping action of the first contacts 40 and 46 with respect to wiping action of the second contacts 41 and 47 of the first spring 39 and the second spring 45, respectively, is controlled by action of the first fingers 51 of the first and second springs 39 and 45 against the inner edges 37 of the first and third recesses 32 and 34, respectively, and action of the second fingers 52 of the first and second springs 39 and 45 against the inner edges 37 of the second and the fourth recesses 33 and 35.

While a rotational type of actuator has been described, it will be appreciated that other types of actuators may be used to deflect the actuator engaging areas 44 and 50 away from each other to affect engagement of the connector spring contacts with the printed wiring board terminals.

Figure 4:
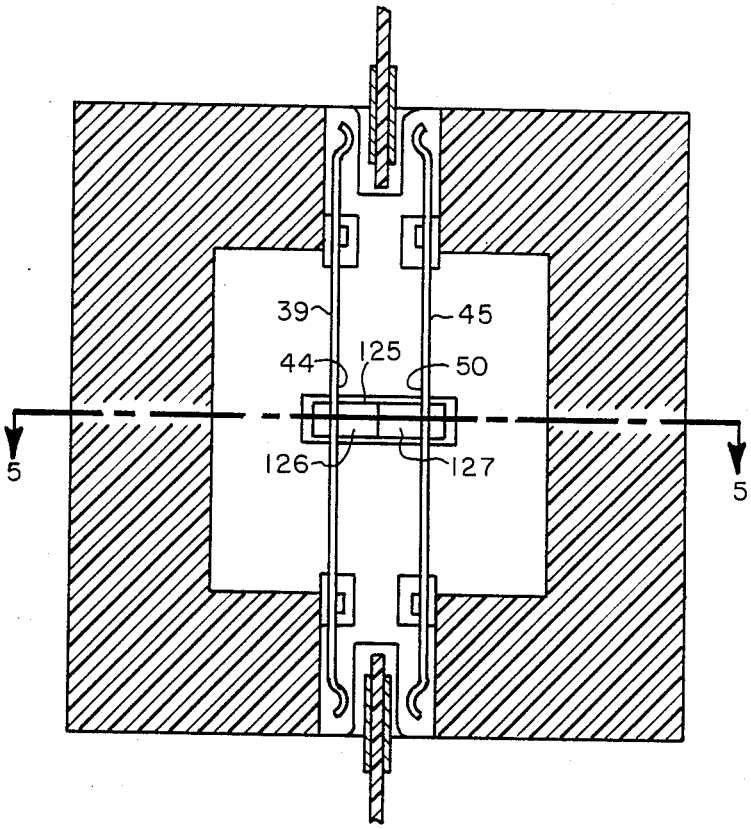
FIG. 4 is a cross sectional view of the connector arrangement of the present invention including an alternate linear actuator.
Figure 5:
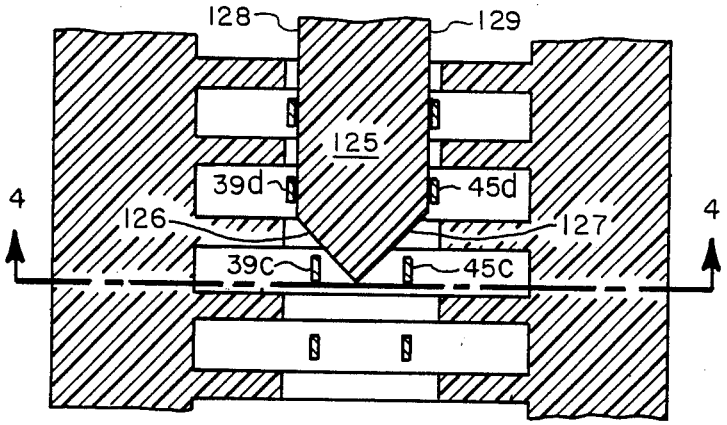
FIG. 5 is a sectional view taken along line 5—5 in FIG. 4.

In this regard and referring to FIGS. 4 and 5 there is shown an embodiment of the connection arrangement of the present invention including an alternate linear actuator having a chisel point including a first sloping face 126 located proximate to the actuator engaging area 44 of the first connection spring 39 and a second sloping face 127 located proximate to the actuator engaging area 50 of the second connection spring 45. The actuator 125 also includes a first side surface 128 and a second side surface 129. Referring to FIG. 5, the linear actuator 125 may be inserted between pairs of the connection springs 39 and 45 to deflect the springs apart thereby pivotally actuating them. In this regard, actuator 125 is shown inserted between the connection springs **39*d* and 45*d* thereby spreading them apart, positioning their actuator engaging areas 44 and 50 in contact with the actuator side surfaces 128 and 129, respectively, and positioning their associated contacts in an engaged position. The actuator 125 is further shown in a position about to enter into engagement with the connection springs 39*c* and 45*c* which, when engaged, will slide along the sloping faces 126 and 127 of the actuator's chisel point thereby deflecting the springs apart and positioning them in an actuated position. It should be noted that the actuator possesses the additional advantage of sequentially operating the springs 39*d* and 45*d* before the springs 39*c* and 45*c***.

The connection springs **39*d*, 39*c*, 45*d* and 45*c* may be released and permitted to assume an unactuated position by removal of the actuator 125 from contact with them. In this regard, the springs 39*c* and 45*c* will be released sequentially before the springs 39*d* and 45*d***.

Figure 3:
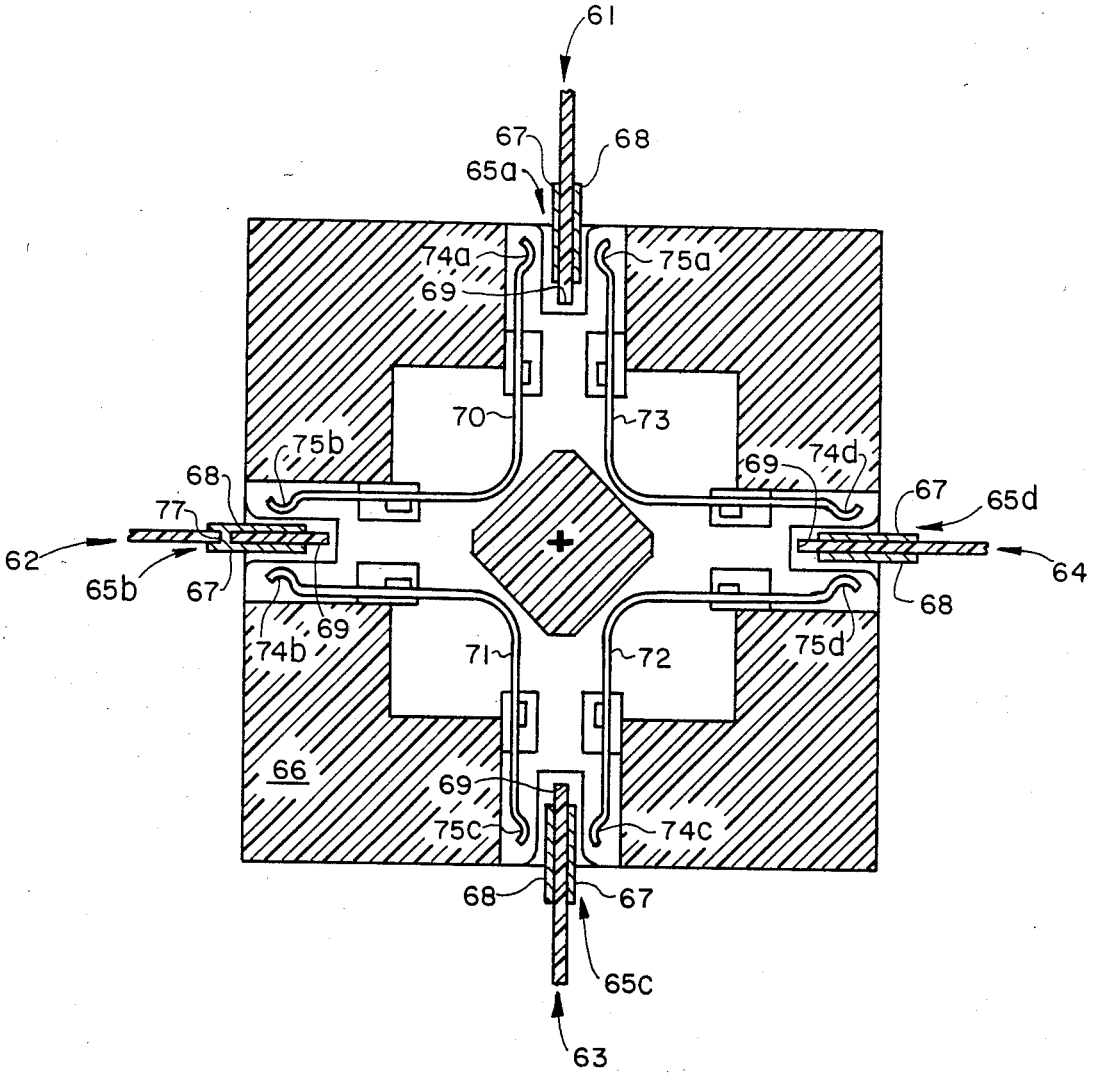
FIG. 3 is a cross sectional view of a zero insertion force connection arrangement for four printed wiring boards in accordance with the present invention.

It will also be appreciated that while the preferred embodiment described above connects two printed wiring boards together, more than two printed wiring boards may be connected in a similar manner. Referring to FIG. 3, there is shown an arrangement for connecting four printed wiring boards. In this regard, a first printed wiring board 61, a second printed wiring board 62, a third printed wiring board 63, and a fourth printed wiring board 64 are shown positioned within a plurality of grooves **65*a–d* of connector body 66. Each of the printed wiring boards 61 through 64 includes a first set of terminals 67 and a second set of terminals 68 positioned near an edge 69 of the printed wiring board. Four pluralities of connection springs 70–73 are located between facing surfaces of adjacent printed wiring boards and positioned to engage corresponding terminals via first contacts 74*a–d* and the second contacts 75*a–d*, respectively. In this regard, the first terminal 67 of first printed wiring board 61 is connected to the second terminal 68 of the second printed wiring board 62 by the connection spring 70, and the contacts 74*a* and 75*b* thereof. Similarly, the first contact 67 of the second printed wiring board 62 may be connected to the second contact 68 of the third printed wiring board 63 by the connection spring 71 and the contacts 74*b* and 75*c* thereof. In like manner, the contacts of the printed wiring board 64 may be connected to corresponding contacts of the printed wiring boards 61 and 63**.

Non-adjacent printed wiring boards may be connected by routing connections through intermediate printed wiring boards. In this regard, a connection may be formed between the first terminal 67 of the first printed wiring board 61 and the second terminal 68 of the third printed wiring board 63 by including a connection 77 between the first terminal 67 and the second terminal 68 of the second printed wiring board 62. The connection thus established would include the contact **74*a*, the spring 70, the contact 75*b*, the terminal 68 of the printed wiring board 62, the connection 77, the terminal 67 of the printed wiring board 62, the contact 74*b*, the spring 71, and the contact 75*c***.

Additional embodiments of the present invention may be realized by combining the details of the first embodiment with the details of the second embodiment. In this regard, a connector may be constructed in a third embodiment (not shown) including a rear connector portion according to the embodiment of FIGS. 1 and 2 and a front portion according to the embodiment of FIG. 3. Alternately, a connector may be constructed in a fourth embodiment (also not shown) including a left side portion according to the embodiment of FIGS. 1 and 2 and a right side portion according to the embodiment of FIG. 3. Such fourth embodiment would yield a three card interconnect connector.

It will now be apparent that a low insertion force arrangement for connecting a plurality of printed wiring boards has been described hereinabove which provides improvements over prior art assemblies. The arrangement may be used to interconnect two printed wiring boards according to the embodiment shown in FIGS. 1 and 2 or the invention may be used to interconnect more than two printed wiring boards as shown in the embodiment of FIG. 3. Two additional embodiments of the present invention have been mentioned which result from the combination of features of the first two embodiments in different manners. A linear actuator is disclosed for use in the disclosed embodiments possessing the advantage of sequentially operating one pair of springs before another pair of springs.

While but four embodiments of the present invention have been disclosed, it will be appreciated by those skilled in the art that numerous modifications of the present invention may be made without departing from the spirit of the invention which shall be limited only by the scope of the claims appended hereto.

What is claimed is:

1. In combination, a first printed wiring board and a second printed wiring board, each printed wiring board including at least one terminal, and a low insertion force arrangement for establishing a connection between said printed wiring boards, said arrangement comprising:

at least one connection spring, said spring including first and second contacts, first and second pivot points and an actuator engaging area, each of said contacts engageably positioned relative to a corresponding one of said terminals;

first and second fulcrums positioned to engage said spring at said first and said second pivot points; and an actuator including at least one sloping ramp positioned proximate to said actuator engaging area, said ramp engaging said engaging area when said actuator is linearly positioned to a first actuator position relative to said spring to pivot said spring about said fulcrums at said pivot points, to a first spring position and thereby causing said contacts to engage with said respective terminals, and said ramp disengaging said engaging area when said actuator is linearly positioned to a second actuator position relative to said spring to pivot said spring to a second spring position and thereby causing said contacts to disengage from said respective terminals.

2. An arrangement as claimed in claim 1, wherein: said arrangement includes a plurality of said connection springs and a connector body including at least two printed wiring board receiving cavities and a plurality of connection spring receiving cavities, said printed wiring boards each positioned within a respective one of said printed wiring board receiving cavities, said connection springs each positioned within an associated one of said connector body spring receiving cavities, said printed wiring board receiving cavities being positioned at an angle to each other, and said actuator including means to sequentially pivot said connection springs.

3. An arrangement as claimed in claim 2, wherein: said actuator includes at least one side surface extending at an angle from said sloping ramp, said side surface engaging said actuator engaging area of each of said plurality of connection springs when said connection springs are pivoted to said first position to maintain said springs so pivoted.

4. An arrangement as claimed in claim 3, wherein: said actuator includes a pair of said sloping ramps.

5. An arrangement as claimed in claim 4, wherein: said actuator includes a pair of said side surfaces engaging corresponding ones of said plurality of connection springs actuator engaging areas.

* * * * *